US006609469B2

(12) United States Patent
Kessler

(10) Patent No.: US 6,609,469 B2
(45) Date of Patent: Aug. 26, 2003

(54) BUTTONHOLE FRAME

(75) Inventor: Rolf Kessler, Karlsruhe (DE)

(73) Assignee: VSM Group AB, Huskvarna (SE)

( * ) Notice: Subject to any disclaimer, the term of this patent is extended or adjusted under 35 U.S.C. 154(b) by 0 days.

(21) Appl. No.: 10/047,568

(22) Filed: Jan. 15, 2002

(65) Prior Publication Data

US 2002/0092212 A1 Jul. 18, 2002

(30) Foreign Application Priority Data

Jan. 15, 2001 (DE) ..... 101 01 442

(51) Int. Cl.[7] ..... D05B 03/06
(52) U.S. Cl. ..... 112/70
(58) Field of Search ..... 112/70, 76, 475.15, 112/119, 103, 470.14; 38/102.2, 102.91

(56) References Cited

U.S. PATENT DOCUMENTS 3,664,288 A 5/1972 Von Boden et al.
4,549,492 A * 10/1985 Albrecht et al.
5,609,115 A * 3/1997 Ayuta et al.
5,848,573 A * 12/1998 Hirano et al.
6,336,416 B1 * 1/2002 French et al.

FOREIGN PATENT DOCUMENTS

DE 34 09 942 C1 4/1985
DE 40 08 148 A1 9/1990
DE 41 13 131 C1 7/1992

* cited by examiner

*Primary Examiner*—Ismael Izaguirre
(74) *Attorney, Agent, or Firm*—Pearne & Gordon LLP

(57) ABSTRACT

A holder for material to be sewn in the form of a buttonhole frame has a frame plate (18) and a movable clamping element (24) with passages (20, 30). The holder (10) for material to be sewn can be fixed in place on a displacement mechanism of a sewing machine, and the material to be sewn can be clamped between the frame plate (18) and the clamping element (24) with the aid of a pressure element (34). To make possible space-saving and assured clamping, a wedge surface (38) is provided which, in the course of the movement of the pressing element (34) into the position in which the material to be sewn is clamped, builds up a pressing force in the clamping element (24) against the frame plate.

9 Claims, 1 Drawing Sheet

BUTTONHOLE FRAME

FIELD OF THE INVENTION

The invention relates to a buttonhole frame arranged to be attached to an adjustment mechanism, in particular an embroidery frame drive mechanism, of a domestic sewing machine, the frame having a frame plate and a clamping element, which is movable in respect to the latter, each of which has passages for the sewing machine needle, wherein the frame plate and the clamping element are arranged to clamp the material to be sewn between them with the aid of a pressing element.

BACKGROUND OF THE INVENTION

Holders for material to be sewn are known in general from U.S. Pat. No. 3,664,288. There, a clamping element, which is pivotable around a hinge, can be pressed against a frame plate by means of a locking lever. However, the described structure is very bulky and is not easily suitable for domestic sewing machines, for example.

DE 40 08 148 C2 describes a clamping element of a folding device for material to be sewn, which is not intended to be used with a domestic sewing machine. The static arrangement also includes a large-size mechanism for lifting the clamping element.

DE 34 09 942 C1 describes a clamping mechanism for material to be sewn specifically for buttonhole sewing machines, wherein the material to be sewn is pressed against a contact plate with the aid of a clamping mechanism.

DE 41 13 131 C1 and DE 1 990 644 U describe elastic supports in a clamping area.

OBJECT AND SUMMARY OF THE INVENTION

It is the object of the present invention to create a buttonhole frame suitable for use with domestic sewing machines.

In accordance with the invention, this object is attained by a buttonhole frame of the type mentioned at the outset, which further comprises a wedge surface which, in the course of the movement of the pressing element into the position where it clamps the material to be sewn, builds up a pressing force on the clamping element against the frame plate, and a restoring spring, which lifts the clamping element off the frame plate in the opened position of the pressing element.

Along with a space-saving arrangement of the whole and a short displacement path of the pressing element, the use of the wedge surface permits an assured holding of the material to be sewn in a defined position. The pressing forces built up by the wedge surface in normal direction in respect to the displacement direction assure a particularly good holding of the material to be sewn in the buttonhole frame, so that the latter cannot slide in the course of processing, for example in the course of sewing a buttonhole.

The restoring spring which, in comparison with separate adjustment mechanisms, also is space-saving, makes manipulation easier since, following the pushing, or pivoting the pressing element back, the clamping element is automatically lifted off the holding plate by the action of the restoring spring, so that the material to be sewn can be easily removed.

In a preferred embodiment of the invention it is provided that the wedge surface is embodied as a pressing element on a longitudinally displaceable slide, and works together with a stationary abutment formed on the holder for the material to be sewn.

With an embodiment of this type, where the slide acts indirectly or directly on the clamping element, the material to be sewn is clamped in the buttonhole frame by a simple linear displacement, and the required holding forces are built up by means of the displacement. Alternatively to this structure it is conceivable to embody the wedge surface on a rotatably seated pressing element, for example in the form of a screw thread, wherein the pressing force is built up by a rotating movement of the pressing element into the clamping position.

Independently of the structure of the pressure element, it is particularly preferred to design the inclined surface in such a way that self-locking of the pressing element occurs and/or a flattening in the area of the end position is provided. In this way it is made possible without an increased structural outlay to assure a secure holding of the pressing element in the clamping position, and therefore an operationally reliable clamping of the material to be sewn in the buttonhole frame.

An embodiment is particularly practical, wherein the pressing element acts on the pivotably seated clamping element. Pivotable seating of the clamping element permits the simple working together with the pressing element which, during the displacement, is directly pushed by the wedge surface against the clamping element, or a pivot arm, for example, which is connected with the clamping element.

In order to be able to optimally match the surface of the passages to the locations to be processed of the material to be sewn, it is provided in a preferred further development of the invention that the frame plate and the clamping element are exchangeably arranged in pairs on the holder for the material to be sewn, wherein each pair has congruent passages.

It is possible in this way to select passages by means of a matched pair consisting of a frame plate and a clamping element which are embodied as accurately as possible in such a way that the needle entry into the material to be sewn takes place near the edge of the passages, so that no variations in the dimensions can occur, even with delicate material to be sewn, which tends to warp. For example, the passages can be designed selectively in a vertical or horizontal arrangement corresponding to the shape of a buttonhole to be sewn.

In order to be able to better compensate different thicknesses of the material to be sewn, a layer of a soft, elastic material, for example sponge rubber, is provided between the frame plate and the clamping element of a further preferred embodiment. The sponge rubber layer is here suitably provided on the contact surface of the clamping element in order not to hinder the insertion and removal of the material to be sewn.

With comparatively thick material to be sewn, the sponge rubber layer can be easily compressed without the pressing forces being increased to a considerable amount, which could possibly result in damage to the material to be sewn when using delicate materials. On the other hand, the sponge rubber layer also provides an assured holding of the material to be sewn in the holder, even with thin materials.

To make the alignment of the material to be sewn easier for the user, at least one stop for the material to be sewn is usefully provided, which defines a set distance from the passages, wherein an adjustable distance of the stop from the passages for adaptation to different sizes is particularly preferable. A scale which shows the distance between the center of the passages and the set position of the stop is a further preferred embodiment for making the manipulation of the holder easier for the user.

An exemplary embodiment of the invention is explained in greater detail in what follows, making reference to the attached drawings.

DETAILED DESCRIPTION OF THE PREFERRED EMBODIMENT

Figure 1:
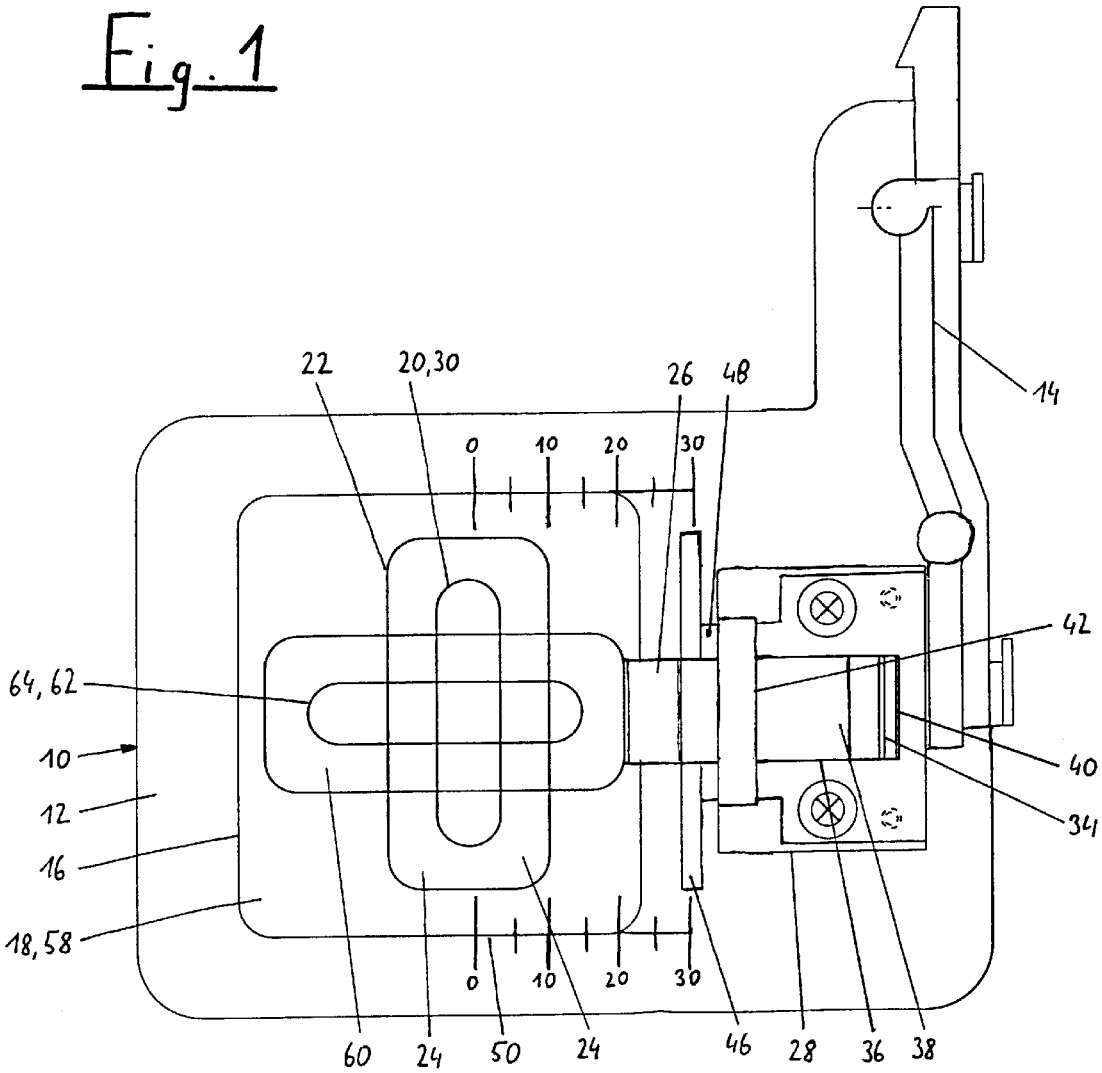
FIG. 1 shows a top view of a buttonhole frame.

A holder 10 for material to be sewn serving as a buttonhole frame is represented in FIG. 1, which has a frame 12 with a flange piece 14, with the aid of which the holder 10 for material to be sewn can be fixed in place on the embroidery frame drive mechanism of a sewing machine, which allows the displacement of the holder 10 for material to be sewn in its plane of extension in a definite manner. A frame plate 18 has been inserted in a cut-in recess 16 in the frame 12, which has a longitudinal slit-like passage 20, around which a depression 22 is provided in the frame plate 18.

Figure 2:
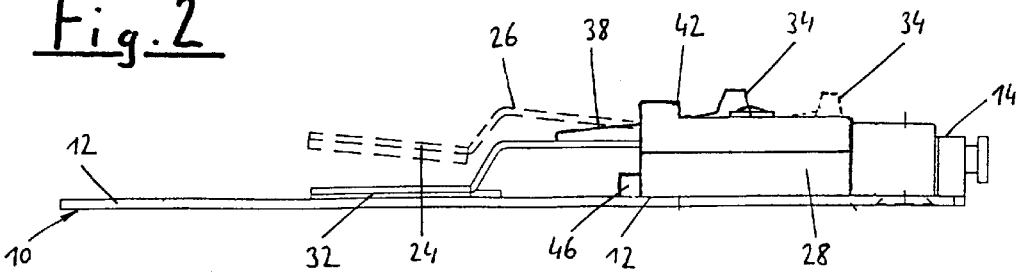
FIG. 2 is a lateral view of the buttonhole frame in accordance with FIG. 1.

A clamping element 24 with a pivot arm 26 formed on it is pivotably seated in a bearing unit 28, wherein a restoring spring (not represented) keeps the clamping element in its position of rest lifted off the frame plate 18. In its outer shape the clamping element 24 essentially corresponds to the depression 22 and also has a passage 30, which is essentially aligned with the passage 20 in the frame plate 18 when the clamping element 24 is in the closed position represented in FIG. 2 in continuous lines. A sponge rubber layer 32 is provided on the underside of the clamping element 24.

To pivot the clamping element 24 from the position of rest (shown in dashed lines in FIG. 2) maintained by means of the restoring spring into the closed position (shown in continuous lines in FIG. 2), a slide 34, which has a wedge surface 38, is guided in a groove 36 of the bearing unit 28. A rear stop 40 at the bearing unit limits the open position of the slide 34. If the slide 34 is moved into the closed position represented in FIG. 2, the wedge surface 38 acts together with a bow-like abutment 42, which is arranged fixed in place on the bearing unit 28 and bridges the guide groove 36 of the slide 34. Because it acts together with the wedge surface, the slide 34, pushed between the abutment 42 and the resiliently seated pivot arm 26, acts as a wedge and builds up a pressing force, which acts counter to the spring force of the restoring spring of the clamping element 24, because of which the clamping element 24 is lowered and its sponge rubber layer 32 is pressed against the depression 22 of the frame plate 18 in the area of the closed position in accordance with FIG. 2. Because of this, a material to be sewn inserted between the clamping element 24 and the frame plate 18 is securely clamped in the holder 10 for material to be sewn, so that thereafter a buttonhole indicated in FIG. 2 can be sewn.

In the process the embroidery frame drive mechanism of the sewing machine displaces the entire holder 10 for material to be sewn in accordance with the shape of the buttonhole wherein a secure holding of the material to be sewn is assured by the embodiment of the passages 20, 30, which approximates the shape of the buttonhole, and a displacement need not be feared even with delicate materials.

A stop 46, which can be pulled out of the bearing unit 28 in various positions with the aid of a holder 48, is provided for precise work, wherein a scale 50 shows the distance of the stop 46 from the center of the passages 20, 30. After orienting the stop 46, the buttonhole facing of the material to be sewn can be placed against the latter, and after clamping the clamping element 24 in place, the material to be sewn is in an exactly defined position. Here, the sponge rubber layer compensates the differences in thickness of various materials and assures that the pressing force does not change to a considerable degree in case of different thicknesses of materials to be sewn.

In order to be able to achieve different seam shapes, along with an optimum clamping of the material to be sewn, the frame plate 18 and the clamping element 24 are designed to be interchangeable. For example, the frame plate 18 and the clamping element 24 shown in FIG. 1 can be exchanged for the pair, consisting of a frame plate 58 and a corresponding clamping element 60, also shown in FIG. 1. In this case the passages 62, or 64, respectively, of this frame plate 58 and the clamping element 60 are placed transversely in respect to the orientation of the passages 20, 30 in accordance with the other embodiment shown in FIG. 1 and permit the sewing of buttonholes in accordance with the orientation. The remaining design characteristics of the frame plate 58 and the clamping element 60 correspond to the embodiment represented in FIGS. 1 and 2. Of course further exchange pairs with passages corresponding to other seam shapes to be sewn are conceivable, also conceivable is a cross-shaped embodiment of the passages for processing vertical and horizontal button holds with only one set consisting of a frame plate and a clamping element.

What is claimed is:

1. A buttonhole frame arranged to be attached to an adjustment mechanism of a domestic sewing machine, comprising a frame plate (18, 58) and a clamping element (24, 60), which is movable in respect to the latter, each of which has passages (20, 30, 62, 64) for the sewing machine needle, wherein the frame plate (18, 58) and the clamping element (24, 60) are arranged to clamp the material to be sewn between them with the aid of a pressing element (34), characterized in that the buttonhole frame comprises a wedge surface (38) which, in the course of the movement of the pressing element (34) into the position where it clamps the material to be sewn, builds up a pressing force on the clamping element (24, 60) against the frame plate (18, 58), said wedge surface (38) being embodied on a longitudinally displaceable slide (34). and cooperating with a stationary abutment (42) formed on the holder (10, 28) for the material to be sewn.

2. A buttonhole frame to be attached to an adjustment mechanism of a domestic sewing machine, comprising a frame plate (18, 58) and a clamping element (24, 60), which is movable in respect to the latter, each of which has passages (20, 30, 62, 64) for the sewing machine needle, wherein the frame plate (18, 58) and the clamping element (24, 60) are arranged to clamp the material to be sewn between them with the aid of a pressing element (34), characterized in that the buttonhole frame comprises a wedge surface (38) which, in the movement of the pressing element (34) into the position where it clamps the material to be sewn, builds up a pressing force on the clamping element (24, 60) against the frame plate (18, 58), said wedge surface (38) being arranged to cause a self-locking of the pressing element (34) and/or is provided with a flattening in the area of the end position.

3. The buttonhole frame in accordance with claim 1 or 2, characterized in that the pressing element (34) acts on the pivotably seated clamping element (24, 60).

4. The buttonhole frame in accordance with claim 1 or 2, characterized in that the frame plate (18, 58) and the clamping element (24, 60) are exchangeably arranged in pairs on the holder (10) for the material to be sewn, wherein each such pair (58, 60, 18, 24) has congruent passages (20, 30, 62, 64).

5. The buttonhole frame in accordance with claim 1 or 2, characterized in that a layer (32) of a soft, elastic material, is provided between the frame plate (18, 58) and the clamping element (24, 60).

6. The buttonhole frame in accordance with claim 5, characterized in that a sponge rubber layer (32) is provided on the contact surface of the clamping element (24, 60).

7. The buttonhole frame in accordance with claim 1 or 2, characterized in that at least one stop (46) for the material to be sewn is provided, which defines a set distance from the passages (20, 30, 62, 64).

8. The buttonhole frame in accordance with claim 7, characterized in that the distance of the stop (46) from the passages (20, 30, 62, 64) is adjustable.

9. The buttonhole frame in accordance with claim 8, characterized in that a scale (50) is provided, which shows the distance between a defined position in the passages (20, 30, 62, 64) and the set position of the stop (46).

* * * * *